US009132534B2

(12) United States Patent
Lai

(10) Patent No.: US 9,132,534 B2
(45) Date of Patent: Sep. 15, 2015

(54) SCREWDRIVER BIT

(71) Applicant: Ying-Tsung Lai, Taichung (TW)

(72) Inventor: Ying-Tsung Lai, Taichung (TW)

(73) Assignee: ROTE MATE INDUSTRY CO., LTD, Taiching (TW)

( * ) Notice: Subject to any disclaimer, the term of this patent is extended or adjusted under 35 U.S.C. 154(b) by 40 days.

(21) Appl. No.: 14/011,744

(22) Filed: Aug. 27, 2013

(65) Prior Publication Data

US 2013/0340578 A1 Dec. 26, 2013

Related U.S. Application Data

(63) Continuation-in-part of application No. 12/801,092, filed on May 21, 2010.

(51) Int. Cl.
*B25B 23/00* (2006.01)
*B25B 15/00* (2006.01)

(52) U.S. Cl.
CPC ..... *B25B 15/005* (2013.01); *B25B 15/001* (2013.01)

(58) Field of Classification Search
CPC ..... B23P 15/00
USPC ..... 81/436, 438, 460
See application file for complete search history.

(56) References Cited

U.S. PATENT DOCUMENTS

| | | | | |
|---|---|---|---|---|
| 5,868,047 | A * | 2/1999 | Faust et al. | 81/438 |
| 5,953,969 | A * | 9/1999 | Rosenhan | 81/436 |
| 6,151,994 | A * | 11/2000 | Shiao | 81/61 |
| 6,289,775 | B1 * | 9/2001 | Wei | 81/460 |
| D653,517 | S * | 2/2012 | Lucio et al. | D8/86 |
| 2002/0129680 | A1 * | 9/2002 | Holland-Letz | 81/460 |
| 2003/0131695 | A1 * | 7/2003 | Kozak | 81/460 |
| 2004/0007095 | A1 * | 1/2004 | Meng | 81/53.2 |
| 2005/0076749 | A1 * | 4/2005 | Liu | 81/436 |
| 2008/0092699 | A1 * | 4/2008 | Surowiecki | 81/460 |
| 2009/0056511 | A1 * | 3/2009 | Chen | 81/441 |
| 2009/0282955 | A1 * | 11/2009 | Chang-Kao | 81/438 |
| 2011/0000346 | A1 * | 1/2011 | Chen | 81/438 |
| 2012/0006160 | A1 * | 1/2012 | Wang | 81/438 |
| 2013/0276595 | A1 * | 10/2013 | Liu | 81/438 |

* cited by examiner

*Primary Examiner* — Thomas B Will
*Assistant Examiner* — Mai Nguyen
(74) *Attorney, Agent, or Firm* — Raymond Y. Chan; David and Raymond Patent Firm

(57) ABSTRACT

A screwdriver bit is revealed. The screwdriver bit includes a driving portion, a narrow neck portion integrated with and extended from the driving portion, and a working segment integrated with and extended from the narrow neck portion. The narrow neck portion consists of a connection portion, a first tapered transition, and a second tapered transition. The first tapered transition is an arc taper and the second tapered transition is a straight taper. When the screwdriver bit is driven by a power tool and is rotated at high speed, the torsional stress generated is dispersed by the first tapered transition while the second tapered transition is used to reduce torsional stress of the narrow neck portion. Thus the wearing of the screwdriver bit is effectively reduced.

6 Claims, 5 Drawing Sheets

SCREWDRIVER BIT

CROSS REFERENCE OF RELATED APPLICATION

This is a continuation-in-part application that claims the benefit of priority under 35 U.S.C. §119 to a non-provisional application, application Ser. No. 12/801,092, filed May 21, 2010.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to a screwdriver bit, especially to a screwdriver bit in which the structural strength is improved and the wearing during operation is reduced.

2. Description of Related Arts

Refer to U.S. Pat. No. 5,868,047, an insert bit for use with a powered screwdriver is revealed. An insert bit includes a shank end, a tip end, and a midportion located between the shank end and the tip end. The shank end is insertable into a driver. The tip end is breakable at a first torque while the midportion is breakable at a second torque. The insert bit features on that the midportion is sized so that the second torque is approximately 20% greater than the first torque. The preselected length of the midportion is approximately 18 mm to 23.5 mm while the preselected diameter of the midportion is approximately 3.55 mm to approximately 6.35 mm. The preselected length and preselected diameter of the midportion is selected to permit the shank end to be rotated at least 14 degrees with respect to the tip end without permanent deformation of the impact bit. The insert bit is austempered and has a desired hardness of from 52-56 HRC.

In the above structure, the shank end of the midportion is an arc taper so as to allow the torsional shear stress originally acting on the tip end to act on the shank end of the midportion. Thus the shank end of the midportion has torsional deformation so as to prolong deformation and breakdown time of the whole insert bit.

However, the above structure has following shortcoming. The length of the shank end is larger than the maximum diameter of the tip end of the cross-point-type wings. The longer the length of the shank end, the larger shear stress thereon. When the shear stress reaches the yield point, the shank end breaks. Being driven by high speed and high torque power tools, the screwdriver bit is unable to disperse the torsional stress due to excessive torsional deformation. This is because that the length of the shank end is too long so that severe vibration occurs on the connection between a driving end of the screwdriver bit and the fastener. Thus too much shear stress acting on the shank end results in breakage.

Thus there is room for improvement and a need to provide a novel screwdriver bit.

SUMMARY OF THE PRESENT INVENTION

Therefore it is a primary object of the present invention to provide a screwdriver bit that reduces shear stress and disperses torsional stress property while being acted by torsional stress and shear stress so as to reduce abrasion and wearing of the screwdriver bit and extend service life of the screwdriver bit.

In order to achieve the above object, a screwdriver bit of the present invention includes a connection portion, a driving portion and a narrow neck portion located between the connection portion and the driving portion.

The connection portion is a polygonal column used for connecting to a handle or a pneumatic tool.

A front end of the driving portion is disposed with an operation end and a plurality of curved slots is arranged around a central axis of the operation end. The curved slots can be mounted with a fastener. The fastener is a kind of screw with a mounting slot. For proper length of the screwdriver bit, an effective working segment is set on a front end of the operation end. The screwdriver bit features on that: a reinforcing segment is located between a rear end of each curved slot of the operation end of the driving portion and the edge of the driving portion on the corresponding end. The maximum outer diameter of a cross section of the effective working segment is larger than the length of the narrow neck portion while the diameter of the narrow neck portion is larger or equal to the length of the effective working segment. Moreover, a first tapered transition is disposed between the narrow neck portion and the driving portion while a second tapered transition is arranged between the connection portion and the narrow neck portion. An angle between the first tapered transition and the horizontal line is smaller than an angle between the second tapered transition and the horizontal line. Thereby when the screwdriver bit is used together with a power tool having high rotation speed to generate high torque for driving the fastener into a tight state, the torsional shear stress generated is transferred to the narrow neck portion through the first tapered transition and a part of the torsional shear stress is further transferred to the connection portion. A further part of the stress is used to increase the value of torsional deformation and then is returned to act on the fastener so as to make the rotation and operation of the device more smooth and stable. Furthermore, the abrasion and wearing of the screwdriver bit is effectively reduced.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
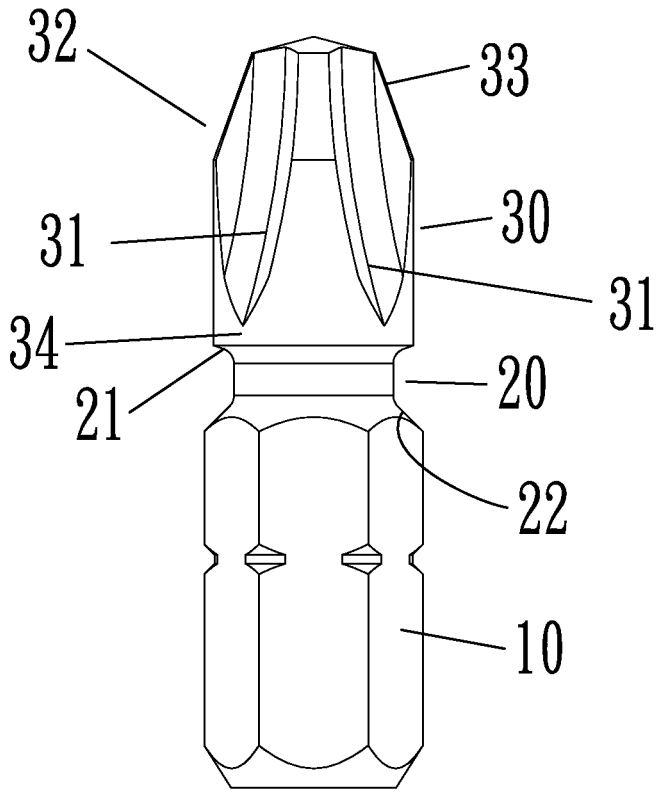
FIG. 1 is a front view of an embodiment according to the present invention.
Figure 2:
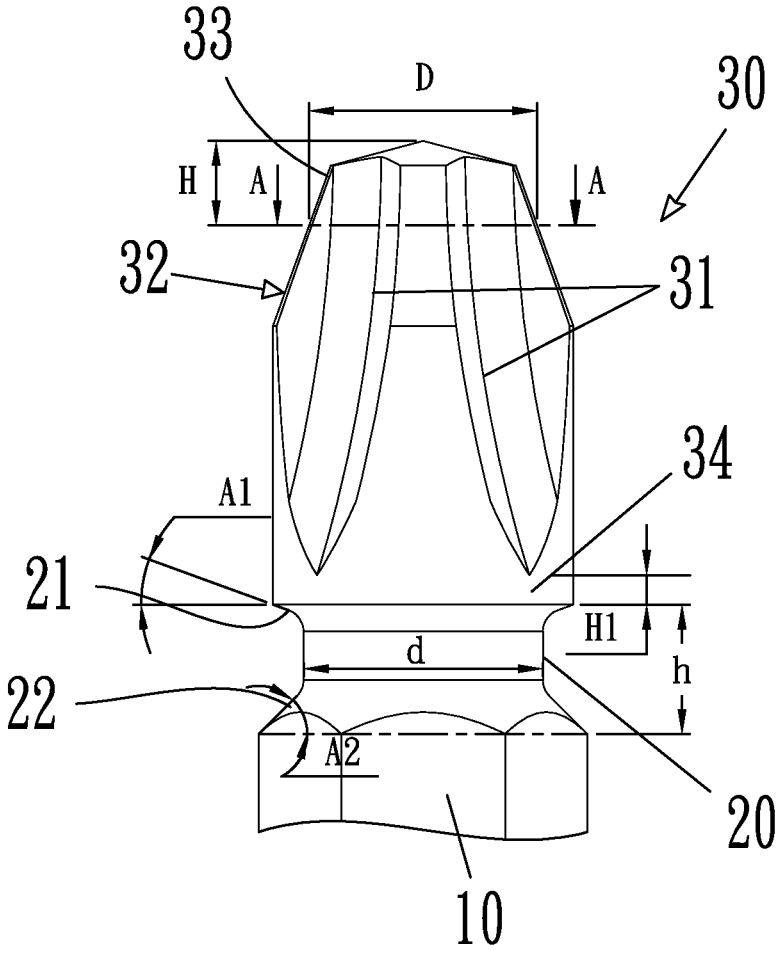
FIG. 2 is a partial enlarged front view of an embodiment according to the present invention.
Figure 3:
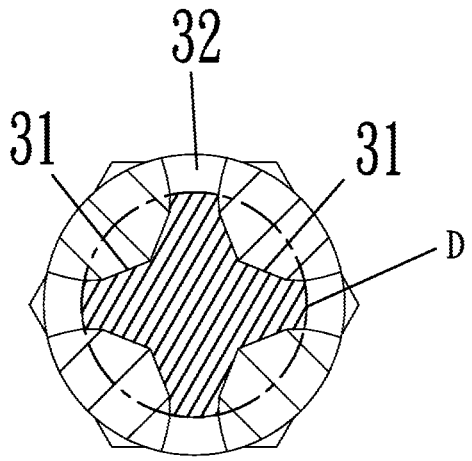
FIG. 3 is a cross sectional view along an A-A line of the embodiment in FIG. 2 according to the present invention.

Refer from FIG. 1 to FIG. 3, a screwdriver bit of the present invention is a rod including a connection portion 10, a narrow neck portion 20, and a driving portion 30.

The connection portion 10 is a polygonal column used for connecting to a handle (not shown in figure) or a pneumatic tool (not shown in figure).

The narrow neck portion 20 is located between the connection portion 10 and the driving portion 30 and is formed on the rod.

Figure 5:
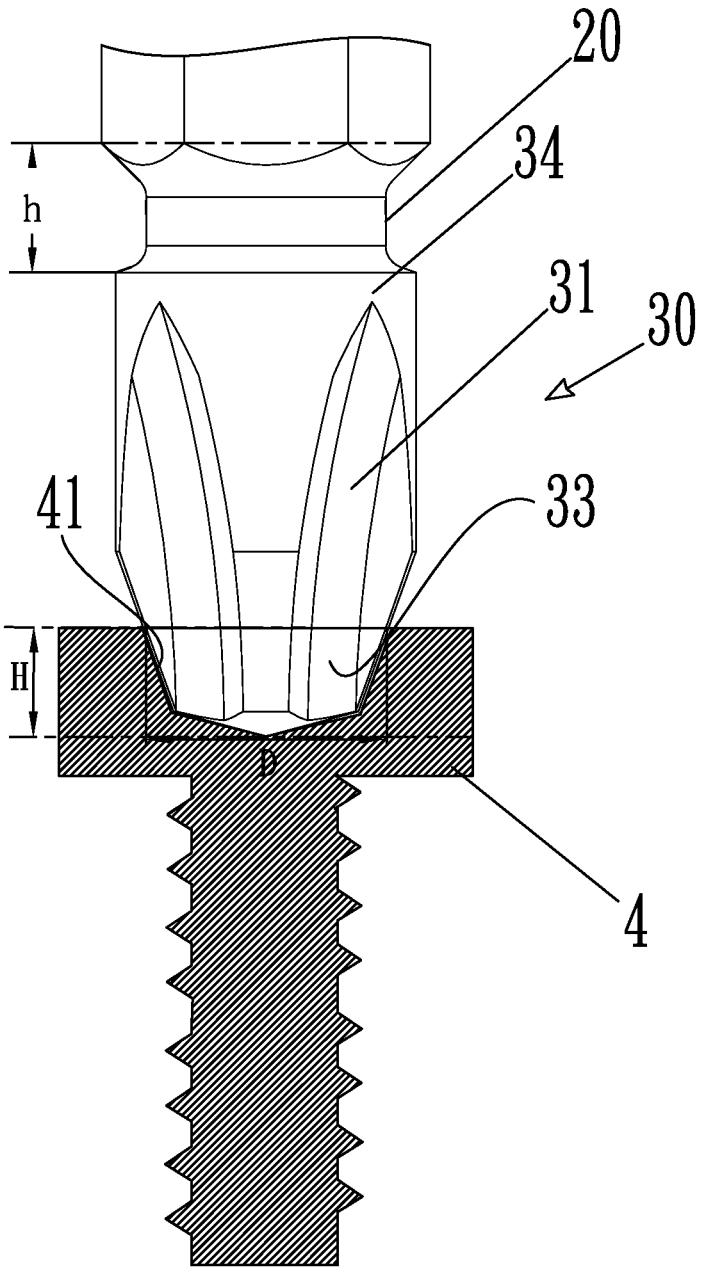
FIG. 5 is a schematic drawing showing an embodiment of the present invention and a fastener.

An operation end 32 is arranged at a front end of the driving portion 30 and a plurality of curved slots 31 is disposed around a central axis of the operation end 32. The curved slots 31 can be mounted with a fastener 4, as shown FIG. 5. The shape of the operation end 32 can be a flat bladed, cross-shaped, star-shaped or hexagonal. In this embodiment, the operation end 32 is cross-shaped. The fastener 4 is a kind of screw with a mounting slot 41. For proper length of the screwdriver bit, an effective working segment 33 is set on a front end of the operation end 32. The length of the effective working segment 33 is defined as a depth H of the operation end 32 being mounted into the mounting slot 41 of the fastener 4 (screw head) while the operation end 32 is produced by the international standard. As to the maximum outer diameter D of a cross section of the effective working segment 33, its production also meets the international standard, ranging from 3.5 mm to 6.5 mm.

The curved slots 31 arranged around a central axis of the operation end 32 of the driving portion 30 extend downward to the position near the narrow neck portion 20, but not connected to the narrow neck portion 20. They are connected to a reinforcing segment 34 before getting close to the narrow neck portion 20. The rear end of each curved slot 31 doesn't extend to connect to the narrow neck portion 20. The reinforcing segment 34 works for enhancing structural strength of the driving portion 30 weakened by the curved slots 31. Moreover, as shown in FIG. 2, the maximum outer diameter D of a cross section of the effective working segment 33 with the depth H is ranging from 3.5 mm to 6.5 mm while the length of the narrow neck portion 20 mentioned is ranging from 3 mm to 6 mm. It should be noted that the length D is no less than the length h ($D \geq h$).

Furthermore, a first tapered transition 21 is disposed between the narrow neck portion 20 and the driving portion 30 while a second tapered transition 22 is arranged between the connection portion 10 and the narrow neck portion 20. An angle A1 between the first tapered transition 21 and the horizontal line is smaller than an angle A2 between the second tapered transition 22 and the horizontal line. It should be noted that the first tapered transition 21 is an arc taper while the second tapered transition 22 is a straight taper. After the fastener 4 being driven and pressed into a tight state by the screwdriver bit used in combination with power tools having a high rotation speed for generating high torque, the torsional stress is dispersed by proper torsional deformation of the arc taper design of the first tapered transition 21. And the torsional deformation of the narrow neck portion 20 is properly reduced due to the straight taper design of the second tapered transition 22. A part of the length h of the narrow neck portion 20 is returned to act on the fastener 4 through the first tapered transition 21 and the operation end 32 so as to make the operation more smooth and stable. The abrasion and wearing of the screwdriver bit is further reduced.

When the effective working segment 33 of the driving portion 30 is driven and rotated by the power tool to a top, the arc taper shape of the first tapered transition 21 causes twisting of the torsional stress generated and further provides a bit elasticity of the narrow neck portion 20 so as to reduce shear stress of the narrow neck portion 20. Then the torsional stress is further reduced by the straight taper shaped second tapered transition 22 so as to prevent the narrow neck portion 20 from being twisted too much and got broken. The device features on that the length h of the narrow neck portion 20 is no more than the diameter D of the effective working segment 33. The effective working segment 33 of different sized screwdriver bits has different diameter. In this embodiment, the maximum outer diameter D of a cross section of the effective working segment 33 is ranging from 3.5 mm to 6.5 mm while the length of the narrow neck portion 20 is ranging from 3 mm to 6 mm.

The longer the length of the narrow neck portion 20, the larger the shear stress. The shorter the length of the narrow neck portion 20, the smaller the shear stress. Thus the length of the narrow neck portion 20 is no more than the maximum outer diameter D of a cross section of the effective working segment 33.

For achieving proper torsional flexibility of the screwdriver bit of the present invention, the first tapered transition 21 is designed into arc taper shaped. In order to prevent excessive torsional flexibility, the second tapered transition 22 is designed into straight taper shaped for reducing the torsional flexibility.

After being driven and rotated by the high speed and high torque power tool to the top, the torsional deformation value of the screwdriver bit is increased by means of the narrow neck portion 20. Moreover, the length of the narrow neck portion 20 is smaller than the maximum outer diameter D of a cross section of the effective working segment 33 and the diameter of the narrow neck portion 20 is larger is equal to the length H of the effective working segment 33. Thus the shear stress generated after the screwdriver bit being rotated is reduced and the torsional deformation force is increased due to the first tapered transition 21. Furthermore, the torsional deformation force generated by the first tapered transition 21 is stopped due to the straight taper shape of the second tapered transition 22 when the narrow neck portion 20 is extended to the second tapered transition 22.

According to the returning force mentioned above, a part of torsion is transferred to the fastener. Thus the screwdriver bit of the present invention will not be damaged.

Figure 4:
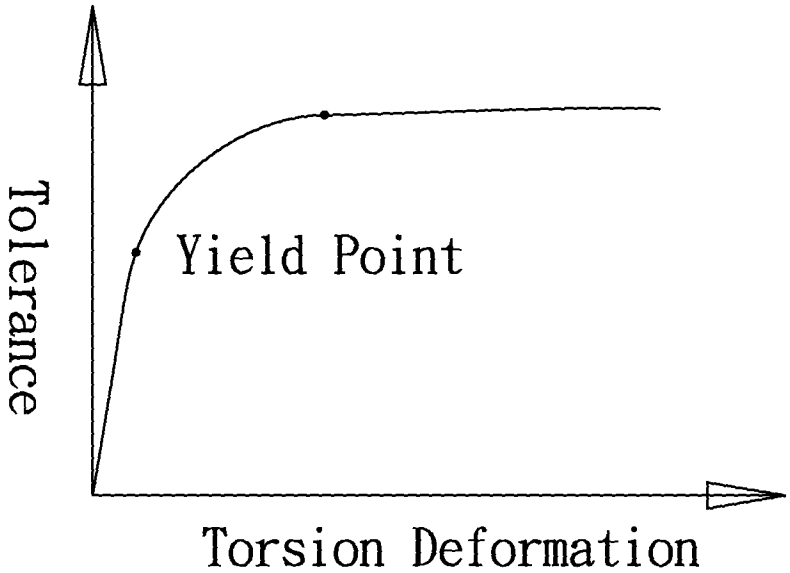
FIG. 4 is a schematic drawing showing a torque-deformation curve of an embodiment according to the present invention.

As shown in FIG. 4, when the screwdriver bit of the present invention being affected by torsion, the torsional deformation is increased. Before the torsion reaching the yield point, the torsional deformation generated is in an elastic deformation area that is reversible. After the torsion being over the yield point, the torsional deformation enters an elastic plastic deformation area that is irreversible. Due to the design of the narrow neck portion 20, the torsional deformation curve after the yield point extends gradually and continues staying in the extended elastic plastic deformation area. Thus the effective working segment 33 will not get damaged.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A screwdriver bit, comprising:

a connection portion;

a narrow neck portion having a rod shape and defining a uniform diameter;

a driving portion having an operation end is arranged at a front end of said driving portion, an effective working segment disposed on a front end of the operation end, and a reinforcing segment, wherein said diameter of said narrow neck portion is larger or equal to a length of said effective working segment;

a first tapered transition extended from said reinforcing segment of said driving portion to said narrow neck portion, wherein said first tapered transition is an arc taper defining an arc surface extended between said driving portion and said narrow neck portion;

a second tapered transition extended from said connecting portion to said narrow neck portion, such that said narrow neck portion is extended between said first tapered transition and said second tapered transition, wherein said second tapered transition is a straight taper defining a flat surface extended between said connecting portion and said narrow neck portion, wherein a maximum outer diameter of said effective working segment is no less than a total length of said narrow neck portion, said first tapered transition, and said second tapered transition, wherein a length of said narrow neck portion is not larger than the maximum outer diameter of said effective working segment, wherein the length of said narrow neck portion is 3 mm to 6 mm.

2. The screwdriver bit, as recited in claim 1, wherein said driving portion further comprises a plurality of curved slots being arranged around a central axis on said front end of said operation end to form said working segment, wherein said reinforcing segment is located between a rear end of each of said curved slots and said first tapered transition for preventing said curved slots being extended to said narrow neck portion.

3. The screwdriver bit, as recited in claim 2, wherein an angle between said first tapered transition and a horizontal line of said driving portion is smaller than an angle between said second tapered transition and said horizontal line of said driving portion.

4. A screwdriver bit, comprising:

a connection portion;

a narrow neck portion having a rod shape and defining a uniform diameter;

a driving portion having an operation end is arranged at a front end of said driving portion, an effective working segment disposed on a front end of the operation end, and a reinforcing segment, wherein said diameter of said narrow neck portion is larger or equal to a length of said effective working segment;

a first tapered transition extended from said reinforcing segment of said driving portion to said narrow neck portion, wherein said first tapered transition is an arc taper defining an arc surface extended between said driving portion and said narrow neck portion;

a second tapered transition extended from said connecting portion to said narrow neck portion, such that said narrow neck portion is extended between said first tapered transition and said second tapered transition, wherein said second tapered transition is a straight taper defining a flat surface extended between said connecting portion and said narrow neck portion, wherein a maximum outer diameter of said effective working segment is no less than a total length of said narrow neck portion, said first tapered transition, and said second tapered transition, wherein a length of said narrow neck portion is not larger than the maximum outer diameter of said effective working segment, wherein the maximum outer diameter of said effective working segment is 3.5 mm to 6.5 mm.

5. The screwdriver bit, as recited in claim 4, wherein said driving portion further comprises a plurality of curved slots being arranged around a central axis on said front end of said operation end to form said working segment, wherein said reinforcing segment is located between a rear end of each of said curved slots and said first tapered transition for preventing said curved slots being extended to said narrow neck portion.

6. The screwdriver bit, as recited in claim 5, wherein an angle between said first tapered transition and a horizontal line of said driving portion is smaller than an angle between said second tapered transition and said horizontal line of said driving portion.

* * * * *